United States Patent [19]

Kritzer

[11] 4,337,826

[45] Jul. 6, 1982

[54] HEAT EXCHANGERS AND METHOD OF MAKING SAME

[75] Inventor: Richard W. Kritzer, Chicago, Ill.

[73] Assignee: Peerless of America, Inc., Chicago, Ill.

[21] Appl. No.: 15,124

[22] Filed: Feb. 26, 1979

[51] Int. Cl.[3] ..... F28D 1/04; B21D 53/02

[52] U.S. Cl. ..... 165/151; 165/181; 29/157.3 B

[58] Field of Search ..... 165/181, 183; 113/118 D; 29/157.3 V, 157.3 A, 157.3 B, 157.3 D

[56] References Cited

U.S. PATENT DOCUMENTS

| | | | |
|---|---|---|---|
| 3,205,563 | 9/1965 | Pauls et al. | 29/157.3 V |
| 3,206,838 | 9/1965 | Pauls | 165/181 |
| 3,384,947 | 5/1968 | Anderson et al. | 29/157.3 V |
| 3,537,516 | 11/1970 | Kunz | 165/181 |
| 3,886,639 | 6/1975 | Pasternak | 165/181 |
| 3,947,941 | 4/1976 | O'Connor et al. | 165/181 |

FOREIGN PATENT DOCUMENTS

| | | | |
|---|---|---|---|
| 52-257 | 4/1977 | Japan | 29/157.3 V |

*Primary Examiner*—Samuel Scott
*Assistant Examiner*—Theophil W. Streule, Jr.
*Attorney, Agent, or Firm*—Emrich, Lee, Brown & Hill

[57] ABSTRACT

A heat exchanger and method of making same, wherein elongated passageways are formed in unbonded portions of a blank made of bonded sheet material, and integral fins are formed on the sheet material with the fins having elongated base portions extending transversely to the length of said passageways. In certain embodiments the finned portions of the heat exchanger are so disposed relative to each other that fins therein project toward the adjacent finned portions.

9 Claims, 15 Drawing Figures

HEAT EXCHANGERS AND METHOD OF MAKING SAME

BACKGROUND OF THE INVENTION

This invention relates to heat exchangers and the method of making the same, and, more particularly, to finned heat exchangers made from blanks of bonded sheets of material, and the method of making such finned heat exchangers.

A primary object of the present invention is to afford both a novel heat exchanger and a novel method of making the same.

Another object of the present invention is to afford a novel finned heat exchanger made from a blank of bonded sheet material.

An object ancillary to the foregoing is to afford a novel finned heat exchanger of the aforementioned type wherein the fins thereof are formed from and as an integral part of the sheet material.

Heat exchangers made from blanks of bonded sheet material have been heretofore known in the art, being shown, for example, in U.S. Pat. Nos. 2,690,002, 3,018,543, 3,275,071 and 3,334,398.

Also, heat exchangers made from blanks of bonded sheet material and having fins formed from such blanks have been heretofore known in the art, being shown, for example, in U.S. Pat. Nos. 3,380,518, 3,463,904, 3,495,657 and 3,611,534.

It is an important object of the present invention to afford novel improvements over heat exchangers of the aforementioned types heretofore known in the art, and to afford novel improvements in the methods of affording such heat exchangers.

Another object of the present invention is to afford a novel heat exchanger made from a blank of bonded sheet material, and which embodies fins constituted and arranged thereon in a novel and expeditious manner.

Another object is to afford a novel heat exchanger of the aforementioned type wherein the fins on adjacent portions of the heat exchanger project toward each other in a novel and expeditious manner.

A further object of the present invention is to afford a novel finned heat exchanger made from a blank of bonded sheet material, and having substantially parallel, elongated tubular portions disposed therein, with the fins extending laterally across the tubular portions and projecting outwardly therefrom.

An object ancillary to the foregoing is to afford a novel finned heat exchanger of the last mentioned type, wherein fins on adjacent ones of the tubular portions project toward adjacent ones of the other tubular portions.

Another object of the present invention is to afford a novel method of making finned tubular heat exchangers from a blank made of bonded sheet material whereby, after the fins have been formed on the blank, the finned tubular portions of the blank may be turned relative to each other, in a novel and expeditious manner, to afford a novel heat exchanger through which air or other working fluid may pass laterally therethrough, between adjacent ones of the tubular portions.

A further object of the present invention is to afford a novel heat exchanger of the aforementioned type, which is practical and efficient in operation, and which may be readily and economically produced commercially in a novel and expeditious manner.

Other and further objects of the present invention will be apparent from the following description and claims and are illustrated in the accompanying drawings which, by way of illustration, show preferred embodiments of the present invention and the principles thereof and what I now consider to be the best mode in which I have contemplated applying these principles. Other embodiments of the invention embodying the same or equivalent principles may be used and structural changes may be made as desired by those skilled in the art without departing from the present invention and the purview of the appended claims.

DESCRIPTION OF THE EMBODIMENTS SHOWN HEREIN

Figure 11:
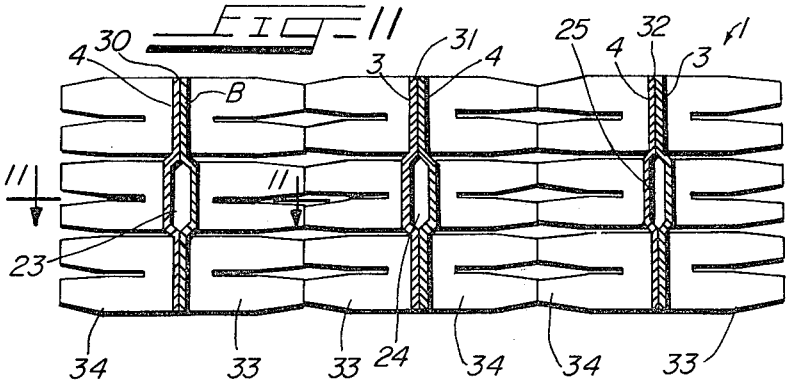
FIG. 11 is a detail sectional view, taken substantially along the line 11—11 in FIG. 10.
Figure 10:
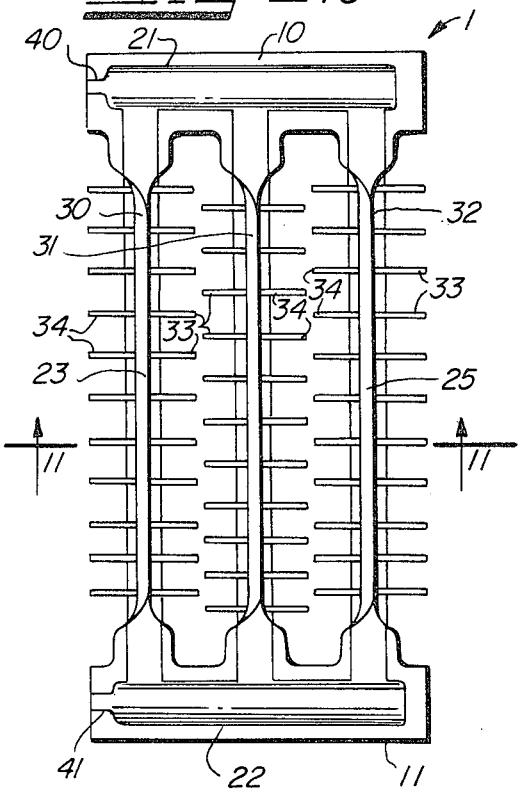
FIG. 10 is a plan view, similar to FIG. 6, but showing the blank of sheet material after a turning or twisting operation has been performed thereon.

In FIGS. 1–11 of the drawings a method of making a heat exchanger element 1 embodying the principles of the present invention, and shown in finished form in FIGS. 10 and 11, is shown to illustrate the presently preferred embodiment of the present invention, and to illustrate the presently preferred method of making heat exchangers in accordance with the principles of the present invention.

In the method illustrated in FIGS. 1–11, a blank 2 is first formed, with the blank 2 embodying two sheets 3 and 4 of suitable material, such as, for example, an aluminum alloy or a copper alloy, bonded together in face-to-face relation to each other, and with a suitable pattern formed therebetween with a weld-inhibiting material 5. The bonding of the two sheets 3 and 4 together may be accomplished in any suitable manner, such as, for example, by the method disclosed in Grenell U.S. Pat. No. 2,690,002. In general, in the preferred method of making the blank 2, the two sheets 3 and 4 are first cleaned and brushed, and then the desired pattern is formed by applying the weld-inhibiting material 5 to one or both of the faces 6 and 7 of the sheets 3 and 4, respectively, which are to become the inner faces of the sheets 3 and 4 in the assembled blank 2. Thereafter, the faces 6 and 7 of the sheets 3 and 4 are bonded together at the places thereon which do not contain the weld-inhibiting material 5, this bonding being effected in any suitable manner, such as, for example, by either hot rolling or cold rolling, as disclosed in the aforementioned U.S. Pat. No. 2,690,002.

Figures 1, 2, 3:
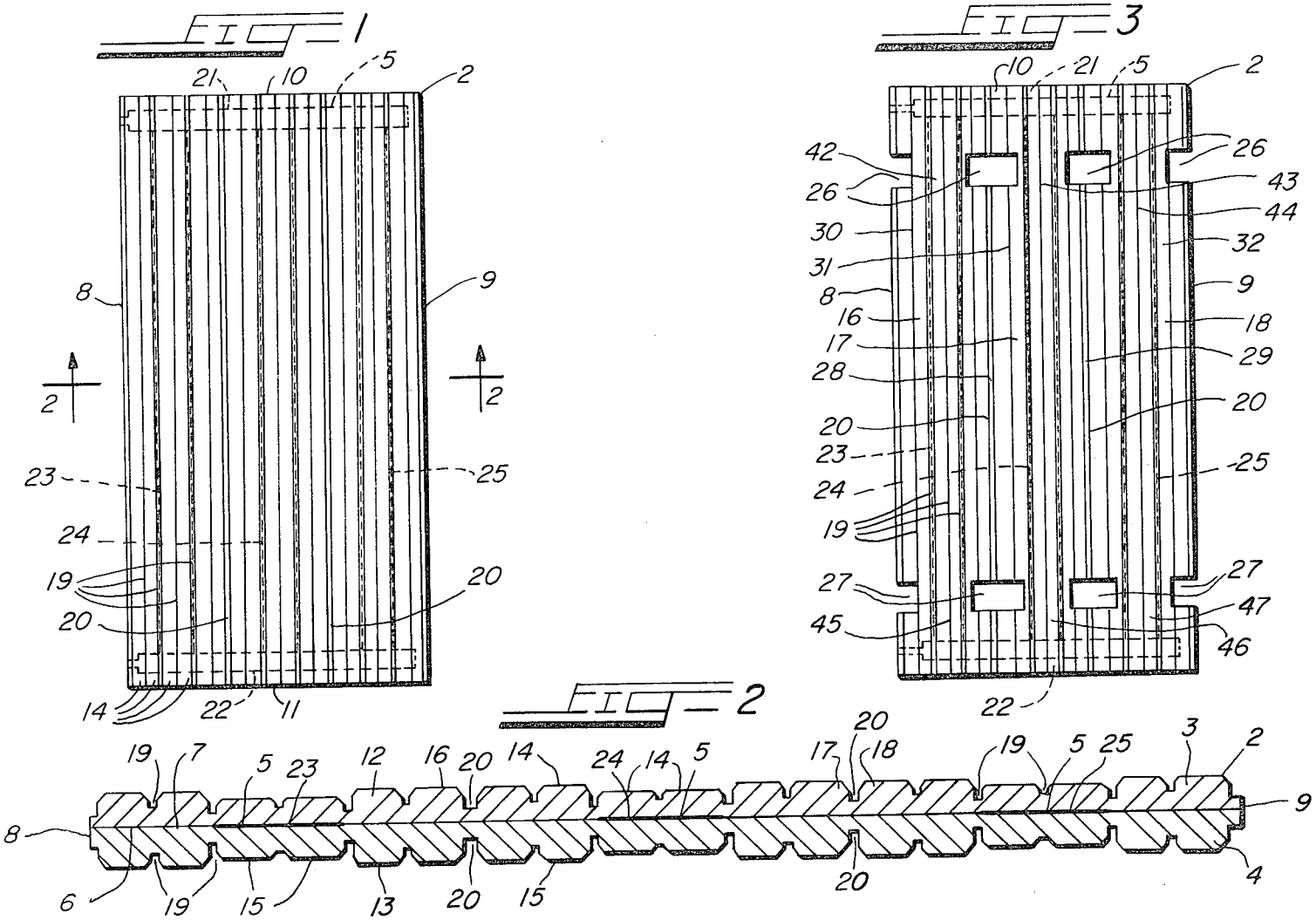
FIG. 1 is a plan view illustrating a blank of sheet material used in the practice of the present invention.
FIG. 2 is an enlarged, detail sectional view taken substantially along the line 2—2 in FIG. 1.
FIG. 3 is a plan view similar to FIG. 1, but illustrating a further step in the process of the present invention.

The blank 2 shown in the drawings, FIGS. 1 and 2, is substantially rectangular in shape, having two oppositely disposed, substantially parallel longitudinal edges 8 and 9 interconnected at their opposite ends by respective end edges 10 and 11. In the preferred form of the blank 2, the outer faces 12 and 13 of the sheets 3 and 4 have a plurality of elongated ribs 14 and 15 formed thereon, respectively, and extending longitudinally thereof in spaced parallel relation to each other and to the longitudinal edges 8 and 9.

When the sheets 3 and 4 are bonded together by either of the aforementioned rolling processes, the bonding process normally causes the sheets to lengthen to approximately twice their original length. In forming the ribs 14 and 15, they may be formed before, during or after the bonding process, but I prefer that they be formed during the bonding process.

In the blank 2 shown in the drawings, the ribs 14 and 15 are formed in directly opposite relation to corresponding ribs 15 and 14, respectively, on the other side thereof, and they are formed in three sets 16, 17 and 18 of each of the ribs 14 and 15, FIG. 2. In each of the sets 16–18, each adjacent pair of the ribs 14 and 15 are separated from each other by elongated grooves or recesses 19, which, preferably, are relatively narrow in width. The adjacent ones of the sets 16–18 are separated from each other by elongated grooves or recesses 20, which, preferably, are of substantially greater width than the recesses 19, for a purpose which will be discussed in greater detail hereinafter. Also, for a purpose which will be discussed in greater detail presently, and as may be seen in FIG. 2, in each of the sets 16–18, the center two ribs 14 and 15 project transversely outwardly a lesser distance than the adjacent two ribs 14 and 15 disposed on opposite sides thereof.

In the blank 2 shown in the drawings, the weld-inhibiting material 5 is disposed in a pattern embodying two elongated, substantially straight, parallel members 21 and 22 disposed adjacent to the end edges 10 and 11, respectively, of the blank 2, and extending laterally across the blank 2 from the longitudinal edge 8 thereof and terminating in inwardly spaced relation to the longitudinal edge 9 thereof. The pattern afforded by the weld-inhibiting material 5 also embodies three spaced, elongated, substantially straight, parallel members 23, 24 and 25, disposed in spaced, parallel relation to the longitudinal edges 8 and 9 of the blank 2 and extending between and interconnecting with the members 21 and 22, FIG. 1. The members 23–25 are disposed between the central pair of ribs 14 and 15 in each of the sets 16–18, FIGS. 1 and 2, and, preferably, extend transversely across the entire transverse width of each of the respective pair of ribs 14 and 15 between which they are disposed.

It will be seen that with this construction, except for the unjoined portions or areas afforded by the members 21–25, all other portions or areas of the sheets 3 and 4 of the blank 2 are bonded together.

After the blank 2 has thus been formed, four laterally spaced openings or holes 26 and four laterally spaced openings or holes 27 may be formed through respective end portions of the blank 2 in inwardly spaced, substantially parallel relation to the members 21 and 22, respectively, FIG. 3. The openings 26 and 27 preferably are rectangular in shape, with the two outermost of each of the openings 26 and 27 opening outwardly through the longitudinal edges 8 and 9 of the blank 2, and the two innermost of each of the openings 26 and 27 being disposed between and in spaced relation to respective pairs of adjacent ones of the members 23–25. The openings 26 and 27 may be cut or formed in the blank 2 in any suitable manner, such as, for example, by punching them out in a suitable press.

Also, either simultaneously with or following the formation of the openings 26 and 27, the areas of the blank 2 defined by the recesses 20, which are disposed between the adjacent ones of the sets 16–18 of ribs are cut or sheared to afford elongated openings or slots 28 and 29 disposed between the sets 16 and 17 of ribs and the sets 17 and 18 of ribs, respectively, the slots 28 and 29 extending the full length of the portion of the blank 2, which is disposed between the openings 26 and 27, FIG. 3. With this construction the portions 30, 31 and 32 of the blank 2, which comprise the portions of the sets 16, 17 and 18, respectively, FIG. 3, disposed between the openings 26 and 27, are completely separated from each other by the slots 28 and 29.

Thereafter, fins 33 and 34 may be formed on the outer faces 12 and 13, respectively, of the portions 30–32 of the blank 2. The fins 33 and 34 may be of any desired construction, but, preferably, are of the type that embody an elongated base portion 35 projecting outwardly from and integral with the respective sheets 3 and 4, with each of the fins also embodying two spines 36 projecting outwardly from the base portion 35 thereof, FIG. 7.

The fins 33 and 34 may be formed in any suitable manner, but preferably, are formed in a manner similar to that disclosed in U.S. Pat. No. 3,692,105, issued to Joseph M. O'Connor on Sept. 19, 1972, with individual fins 33 and 34 being cut or gouged from adjacent pairs of the ribs 14 and 15, respectively, and the portions of the sheets 3 and 4 underlying the ribs 14 and 15.

Figure 4:
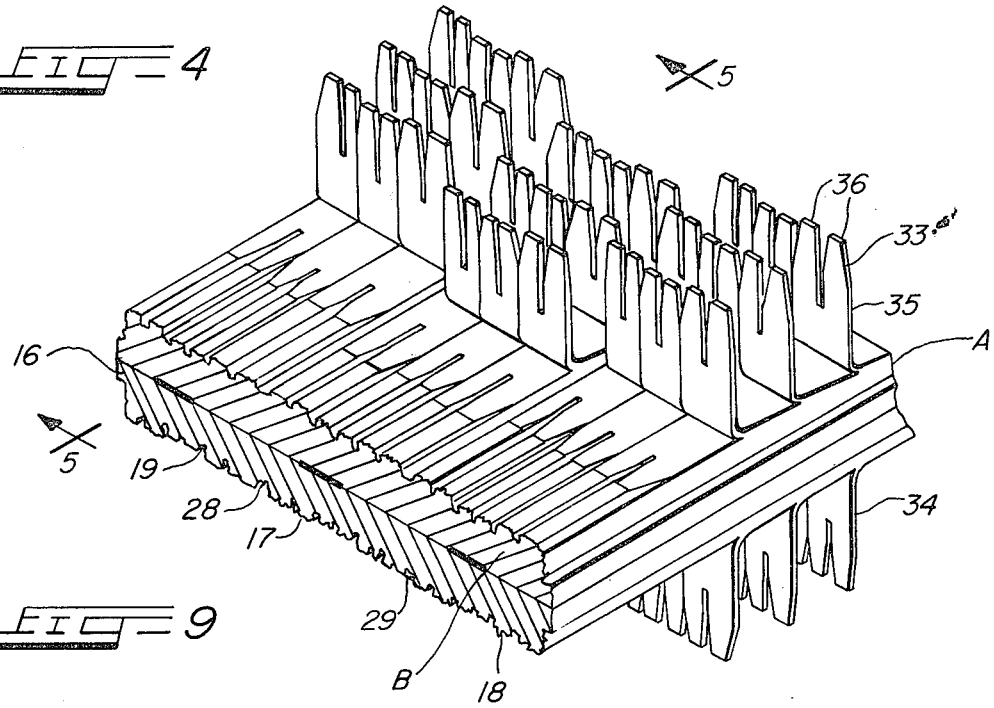
FIG. 4 is a fragmentary, perspective view of the blank of sheet material shown in FIG. 3, illustrating a further step in the process of the present invention.
Figure 9:
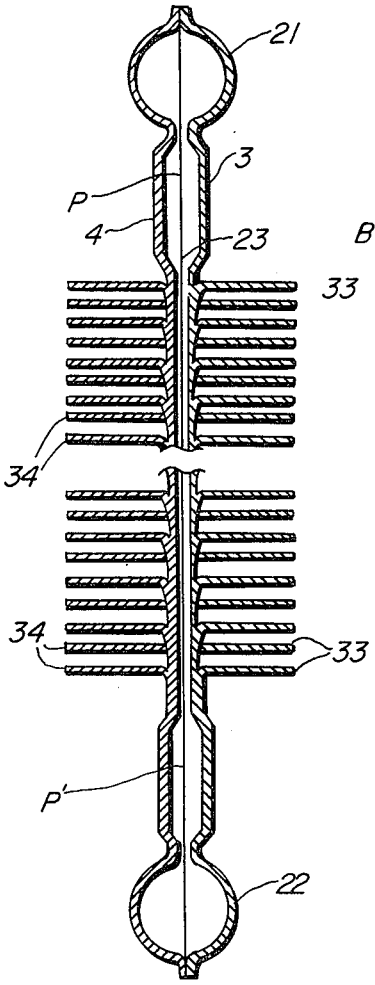
FIG. 9 is a detail sectional view taken substantially along the line 9—9 in FIG. 8.
Figure 5:
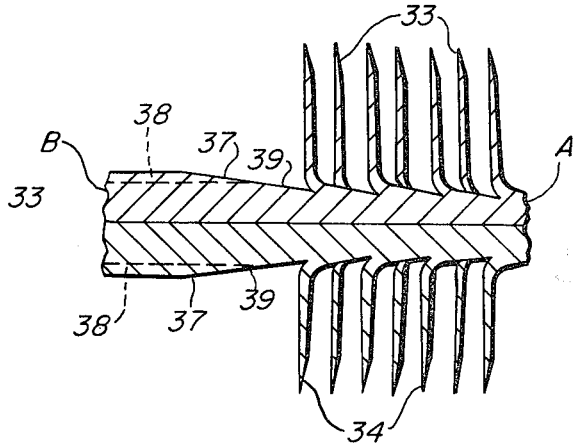
FIG. 5 is a fragmentary, detail sectional view taken substantially along the line 5—5 in FIG. 4.

In so forming the fins 33 and 34, they may be successively formed on each of the sides 12 and 13 of the portions 30–32 of the blank 2, as somewhat diagrammatically illustrated in FIGS. 4 and 5. In so forming the fins 33 and 34, they may be successively formed from one end portion of the blank 2, such as the end portion A toward the other end portion B thereof, FIGS. 4 and 5. The fins 33 and 34 may each be cut or gouged from the sheets 3 and 4 by means of a suitable cutting tool which first cuts along lengthwise of the ribs 14 and 15, to the right, as viewed in FIG. 5 to form the surface 37, which terminates at its lower end, as viewed in FIG. 5, at the base 38 of the ribs 14 and 15, the cutting tool then continuing to cut along lengthwise of the portion of the sheet 3 or 4 underlying the ribs 14 or 15, respectively, to form the surface 39, FIG. 5. The fin 33 or 34, which has thus been cut or gouged from the blank 2, is then bent outwardly preferably to a position approximately perpendicular to the plane of the sheet 3 or 4 on which it is formed.

Figure 6:
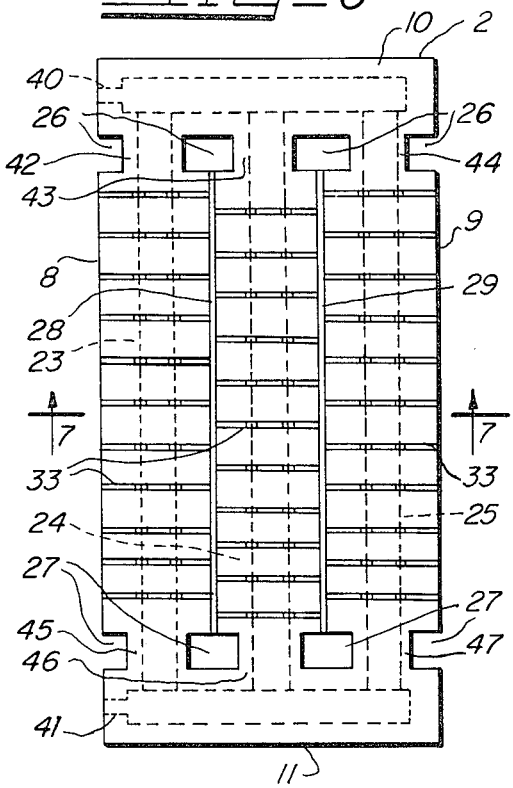
FIG. 6 is a plan view, similar to FIG. 1, but showing the blank of sheet material after the steps in the process illustrated in FIGS. 4 and 5 have been taken.

Preferably, in the formation of the fins 3 and 4, the fins on the portions 30 and 32 of the blank 2 are disposed in uniplanar relation to each other, and the fins on the portion 31 of the blank 2 are disposed on planes midway between the planes of the fins on the portions 30 and 32, as shown in FIGS. 4 and 6.

Preferably, before forming the fins 33 and 34 on the blank 2, and after forming the openings 26–29 therein, the outer faces 12 and 13 of the end portions of the blank 2, outwardly, longitudinally of the blank 2, of the portion of the blank 2 used to form the longitudinally outermost fins 14 and 15, are reduced in thickness and smoothed, in a suitable operation, such as, for example, by grinding, to thereby eliminate the ribs 14 and 15 and dispose the outer faces of the end portions of the blank 2 in substantially uniplanar relation to the inner ends of the bases 35 of the fins 33 and 34, after the latter have been formed.

Figure 7:
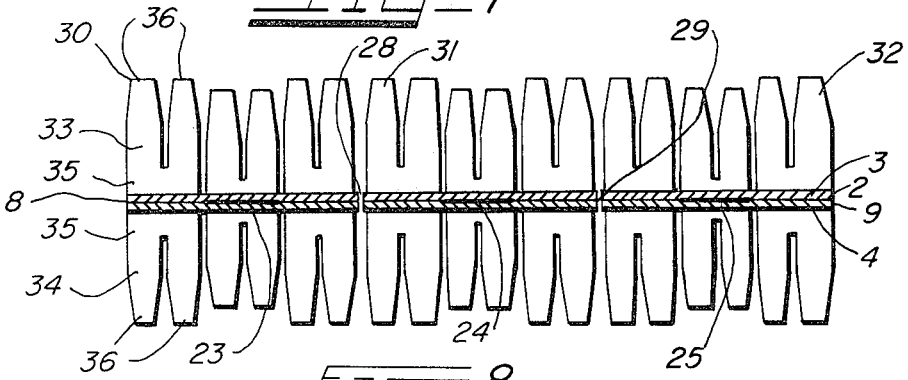
FIG. 7 is an enlarged, detail sectional view taken substantially along the line 7—7 in FIG. 6.

It is to be observed that with the aforementioned construction of the blank 2, wherein the centermost pair of fins 14 and 15 of each of the sets 16–18 project transversely outwardly a lesser distance than the other fins 14 and 15, when the fins 33 and 34 are formed on the blank 2, the center fins 33 or 34 in each of the sets 16–18 are shorter than the adjacent fins on each side thereof, as shown in FIG. 7. This is for a purpose which will be discussed presently.

Figure 8:
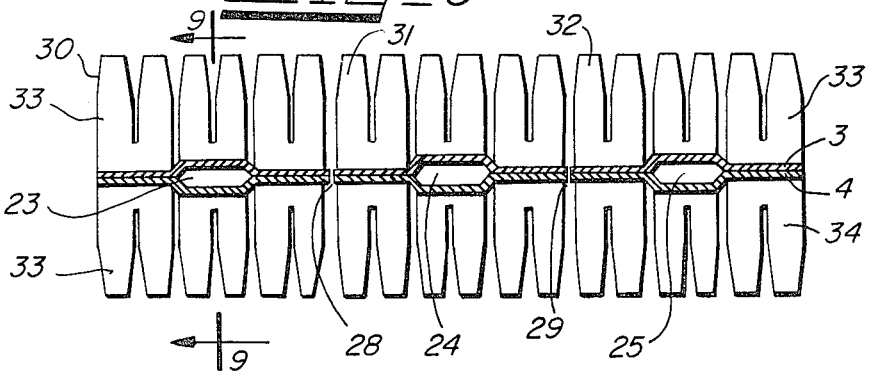
FIG. 8 is a detail sectional view, similar to FIG. 7, but showing the blank of sheet material after an expanding operation has been performed thereon.

After the formation of the fins 33 and 34 on the blank 2, the pattern defined by the weld-inhibiting material 5 may be inflated by the application of internal pressure thereto in any suitable manner, such as, for example, by applying hydraulic pressure to the ends 40 and 41 of the portions 21 and 22 of the pattern, in a suitable manner such as the manner disclosed in the aforementioned Grenell U.S. Pat. No. 2,690,002. Preferably, during the inflation of the pattern defined by the weld-inhibiting material 5, the portions 30–32 of the blank 2 are confined between two platens in a suitable press, or the like, so as to limit the outward expansion of the members 23–25 of the pattern to a substantially rectangular shape, wherein the fins 33 and 34 disposed on opposite sides thereof are moved outwardly into position wherein the outer ends are disposed in uniplanar relation to the adjacent fins 33 and 34 on each side thereof, as shown in FIG. 8. On the other hand, the portions P and P′ of the members 23–25 disposed longitudinally outwardly of the portions 30–32 of the blank 2, and the portions 21 and 22 preferably are unrestricted, or less restricted, so that they are inflated into a substantially round, transverse cross sectional shape, FIG. 9.

After the pattern afforded by the members 21–25 has thus been expanded, the portions 30–32 of the blank 2 may then be rotated around the portions 42, 43 and 44 and the portions 45, 46 and 47 of the blank 2, FIGS. 3 and 6, disposed at the opposite ends of the respective portions 30–32 thereof, between adjacent openings 26 and 27, respectively, from the position shown in FIG. 8 to the position shown in FIG. 10. The finned portions 30–32 of the blank 2 preferably are substantially square in transverse cross section. The rotation of adjacent ones of the portions 30–32 is in opposite directions to each other. Thus, for example, if the rotation of the portion 30 is in a clockwise direction, as viewed in FIG. 8, the rotation of the portion 31 is in a counter clockwise direction and the rotation of the portion 32 is again in a clockwise direction into the position shown in FIG. 10. With this rotation of the portions 30–32, the fins 33 and 34 on the portion 31 pass between the fins 33 and 34 on the portions 30 and 32, respectively, during the rotation of the portions 30–32. In the fully rotated positions of the portions 30–32, as shown in FIG. 10, the free ends of the fins 33 and 34 of the portion 31 are disposed in substantially uniplanar relation to the free ends of the fins 33 and 34 of the portions 30 and 32, respectively.

With this method of construction, a heat exchanger 1, as shown in FIG. 10, is afforded. The heat exchanger 1 embodies two elongated, substantially parallel headers afforded by the portions 21 and 22 of the pattern afforded by the weld-inhibiting material 5, connected by the portions 23–25, which now are tubular in form, with the fins 33 and 34 on the portions 30–32 of the blank 2 projecting from the tubular portions 23–25 in substantially parallel relation to the length of the headers 21 and 22. This, it will be seen, affords an effective heat exchanger wherein air, or the like, may pass between the fins 33 and 34 in a direction transverse to the length of the headers 21 and 22 to cool the working fluid passing through the portions 23–25 between the headers 21 and 22, such as, for example, in the radiator of an automobile, or the like; or to be cooled by the working fluid passing between the headers 21 and 22, such as, for example, in an evaporator of an air conditioning unit, or the like. The headers 21 and 22 may be connected to a suitable source of working fluid, not shown, through the end portions 40 and 41 thereof, FIG. 10.

As will be appreciated by those skilled in the art, the relative thickness and size of the fins 33 and 34, as compared to the other portions of the heat exchanger 1 are shown herein in exaggerated size for the sake of clarity. Preferably, in an actual commercial-form of heat exchanger, such as the heat exchanger 1, the blank 2 would be formed with the ribs 14 and 15 having a transverse thickness in the nature of a few thousandths of an inch and the underlying portions of the sheets 3 and 4 having even a lesser thickness.

Thus, for example, if a heat exchanger 1 were to be formed with the fins 33 and 34 being formed ten to the inch and having a height of 0.75″, and a thickness of 0.009″, it could be formed from a blank 2 wherein the grooves 19 have a depth of 0.04″, the grooves 20 have a depth of 0.06″ and the portions of the sheets 3 and 4 underlying the grooves 20 have a thickness of 0.03″. Preferably, in forming the fins 33 and 34 on such a heat exchanger 1, the cuts made through the ribs 14 and 15 and the underlying portions of the sheets 3 and 4 would be to such a depth that the thickness of the portions of the sheets 3 and 4 underlying the finished fins 33 and 34 would be the aforementioned 0.003″. With this construction, the vertical thickness of the finned blank 2, as viewed in FIG. 8, would be in the nature of 1.56″, and the tubular portions 23–25 preferably would have a lateral width in the nature of 0.48″ and a vertical thickness in the nature of 0.09″, as viewed in FIG. 8.

As will be appreciated by those skilled in the art, the foregoing dimensions are merely by way of illustration, and not by way of limitation, and heat exchangers having other dimensions and fin spacings may be made without departing from the purview of the present invention.

If desired, the fins 33 and 34 may project outwardly from the portions 30–32 a distance sufficient that in the final form of the heat exchanger 1, the fins on adjacent portions 30–32 are interleafed.

Figure 12:
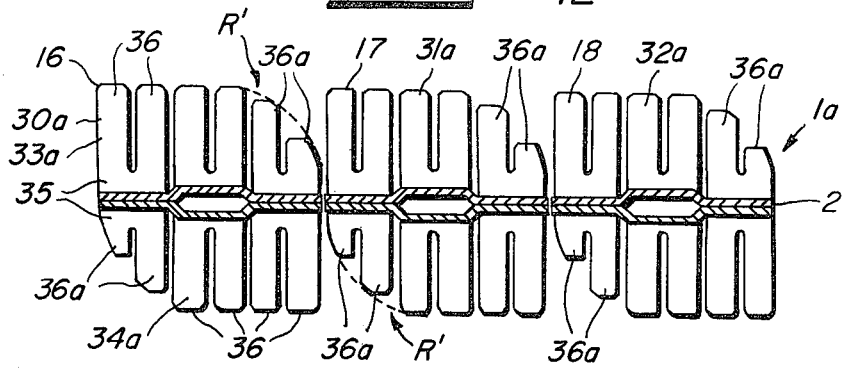
FIG. 12 is a detail sectional view, similar to FIG. 8, but showing a modified form of the present invention.
Figure 13:
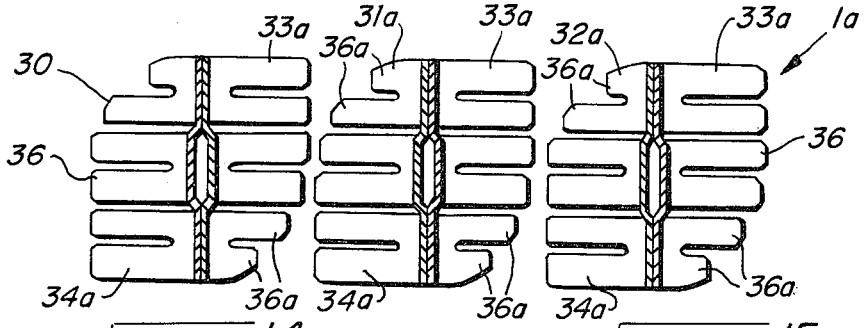
FIG. 13 is a detail sectional view, similar to FIG. 11, but showing the modified form of the present invention illustrated in FIG. 12.

In FIGS. 12 and 13, a modified form of the present invention is shown, and parts which are the same as parts shown in FIGS. 1–11 are illustrated by the same reference numerals, and parts which are similar to, but differ from parts shown in FIGS. 1–11 are shown by the same reference numerals with the suffix "a" added thereto.

The heat exchanger element 1*a*, illustrated in FIGS. 12 and 13, is identical in construction to the heat exchanger element 1 shown in FIGS. 1–11, except that certain of the spines 36*a* on each of the fins 33*a* and 34*a* are shorter in length than the other spines 36 of the fins 33*a* and 34*a*.

It will be remembered that in the formation of the heat exchanger element 1, shown in FIGS. 1–11, adjacent ones of the finned portions 30–32 of the blank 2 are rotated in opposite directions to each other, for example, if the finned portion 30 is rotated in a clockwise direction, as viewed in FIG. 8, the rotation of the portion 31 is in a counter clockwise direction and the rotation of the portion 31 is again in a clockwise direction for the purpose of enabling the portions 30–32 of the heat exchanger 1 to have the aforementioned substantially square transverse shape. However, such opposite rotation of the adjacent portions 30*a*–32*a* of the heat exchanger 1*a* is not necessary.

In each of the sets 16–18 of fins 33*a* and 34*a*, the spines 36*a* at the right side of the fins 33*a* and the spines 36*a* at the left side of the fins 34*a*, as viewed in FIG. 11, are formed to such length and outer configuration that the outer extremities thereof are disposed on the arc of rotation around the longitudinal center lines of the members 23–25 of the outer ends of the next adjacent, center-most spines 36, as indicated by the broken lines R and R″ in FIG. 12. Inasmuch as the lower left fins 36*a* and the upper right fins 36*a* on each of the finned portions 30*a*–32*a* are so formed, it will be seen that during rotation of the portions 30*a*–32*a* in a clockwise direction, as viewed in FIG. 12, these fins will pass each other during the aforementioned rotation of the portions 30*a*–32*a* from the position shown in FIG. 12 to the position shown in FIG. 13, even though the spines 36 and 36*a* on the adjacent finned portions 30*a*–32*a* are disposed in uniplanar relation to each other.

The shortened form of the spines 36*a* may be afforded in any suitable manner, but preferably, is afforded by forming the ribs, not shown, from which they are formed, corresponding to the ribs 14 and 15, of a suitable height and shape so as to automatically form the proper length of spines 36*a*, during the formation of the fins 33*a* and 34*a* in the same manner as previously discussed with respect to the formation of the fins 33 and 34.

Figure 14:
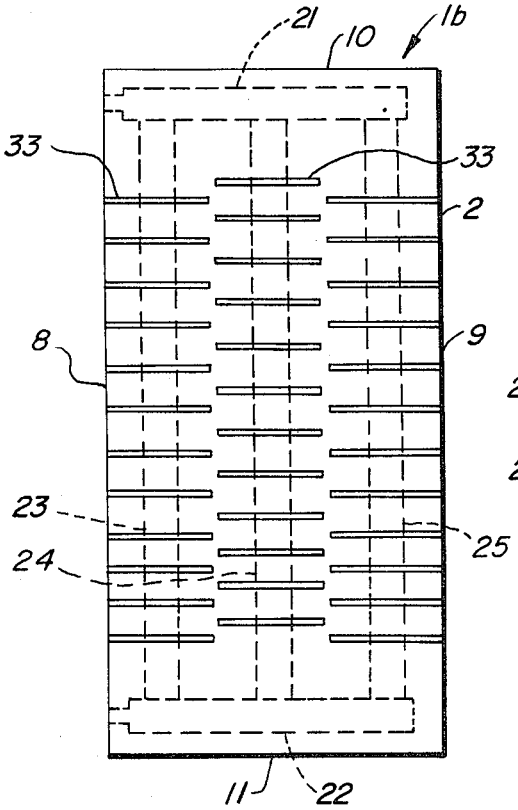
FIG. 14 is a plan view, similar to FIG. 6, but showing a modified form of the present invention.

In FIG. 14 another modified form of the present invention is shown, and parts which are the same as parts shown in FIGS. 1–11 are indicated by the same reference numerals, and parts which are similar to, but differ from parts shown in FIGS. 1–11 are indicated by the same reference numerals with the suffix "b" added thereto.

The heat exchanger 1*b*, shown in FIG. 14, is similar to the construction of the heat exchanger 1 at the stage of manufacture thereof illustrated in FIG. 6, except that no openings such as the openings 26 and 27 and no slots, such as the slots 28 and 29 are formed therein.

In the manufacture of the heat exchanger 1*b*, the blank 2 is formed in the same manner as the blank 2 of the form of the invention shown in FIGS. 1–11 and the fins 33 and 34 are formed thereon in the same manner as heretofore discussed with respect to the formation of the fins 33 and 34 of the heat exchanger element 1, except that on the heat exchanger element 1*b* the fins 33 and 34 are formed on the blank 2 without the latter having been perforated to form the openings 26 and 27 and the slots 28 and 29. As a result, a substantially flat heat exchanger 1*b* is afforded, which embodies a tubular pattern 21–25 with fins 33 and 34 projecting outwardly from oppositely disposed faces of the blank 2 of the heat exchanger 1*b* in the same manner as they project outwardly from the blank 2 of the heat exchanger 1, as shown in FIG. 6.

With this construction, the heat exchanger 1*b* affords a heat exchanger which is particularly useful as an evaporator, or the like, the fins 33 and 34 on opposite sides of the blank 2 of the heat exchanger 1*b* affording passageways for the flow of air, or other working fluid, laterally across both faces of the heat exchanger 1*b*, between the edges 8 and 9 thereof, in good heat exchange relation thereto and to the outer faces of the blank 2.

Figure 15:
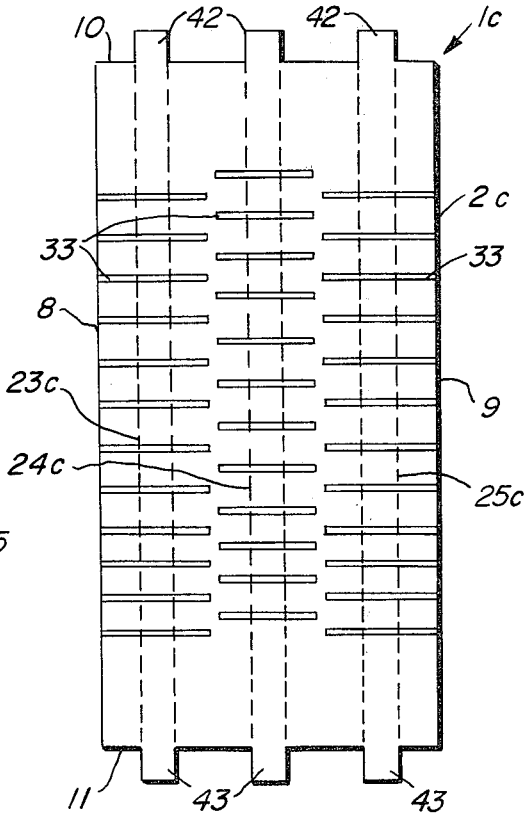
FIG. 15 is a plan view, similar to FIG. 14, but showing another modified form of the present invention.

In FIG. 15, another modified form of the present invention is shown, and parts which are the same as parts shown in FIGS. 1–11 are indicated by the same reference numerals, and parts which are similar to parts shown in FIGS. 1–11 but differ therefrom are indicated by the same reference numerals with the suffix "c" added thereto.

The heat exchanger element 1*c* shown in FIG. 15 is similar to the heat exchanger 1*b* shown in FIG. 14, except that no header portions 21 and 22 are afforded by the weld-inhibiting material 5 applied to the blank 2*c*, and the tubular portions 23*c*–25*c* of the heat exchanger 1*c* extend through the entire length thereof. With this construction, working fluid passing through the tubular portions 23*c*–25*c* passes entirely through the length of the blank 2*c* of the heat exchanger 1*c* in spaced, parallel paths. Connections to the opposite ends of the tubular portions 23*c*–25*c* may be afforded by any suitable means, such as, for example, nipples 42 and 43, respectively.

Like the heat exchanger 1*b*, the heat exchanger element 1*c* affords an effective, substantially flat heat exchanger element, which is particularly well adapted for use in evaporators, and the like.

From the foregoing it will be seen that the present invention affords a novel heat exchanger.

In addition, it will be seen that the present invention affords a novel method of making heat exchangers.

In addition, it will be seen that the present invention affords a novel finned heat exchanger which is practical and efficient in operation, and which may be readily and economically produced commercially.

Thus, while I have illustrated and described the preferred embodiments of my invention, it is to be understood that these are capable of variation and modification, and I therefore do not wish to be limited to the precise details set forth, but desire to avail myself of such changes and alterations as fall within the purview of the following claims.

I claim:

1. A heat exchanger comprising a. two sheet members bonded together in face-to-face relation to each other b. said sheet members defining a plurality of elongated tubular members disposed therebetween in substantially planar spaced relation to each other; and c. said sheet members including a plurality of fins
(1) integral thereto,
(2) spaced from each other along said tubular members,
(3) having elongated base portions extending transversely across said sheets and said tubular members, and
(4) projecting transversely and oppositely outwardly away from said sheets and said tubular members.

2. A heat exchanger as defined in claim 1, and in which
a. said sheet members disposed on each side of said tubular members are of a greater width than the width across each of said elongated tubular members.

3. A heat exchanger, as defined in claim 1, and in which
a. said tubular members open outwardly through oppositely disposed edges of said bonded two sheet members.

4. A heat exchanger as defined in claim 1, and in which
a. said sheet members define two other elongated tubular members
(1) disposed
(a) on opposite sides of said first mentioned tubular members, and
(b) in substantially perpendicular relation to the latter, and
(2) connected to respective opposite ends of said first mentioned tubular members.

5. A heat exchanger as defined in claim 1, or claim 4, and in which
a. fins on respective ones of said tubular members project toward other of said tubular members from which said fins project.

6. A heat exchanger as defined in claim 4, and in which
a. fins on respective ones of said first mentioned tubular members project toward other of said first mentioned tubular members, and
b. said sheet members have a plurality of spaced openings therethrough between said other tubular members and adjacent ones of said fins, and
c. adjacent ones of said openings are disposed on respective opposite sides of respective ones of said first mentioned tubular members.

7. A heat exchanger as defined in claim 1, and in which
a. said sheet members have two pluralities of spaced openings therethrough,
b. said pluralities of openings are disposed between respective opposite edges of said sheet members and adjacent ones of said fins,
c. adjacent ones of said openings in respective ones of said pluralities are disposed on respective opposite sides of respective ones of said tubular members, and
d. fins on respective ones of said tubular members project toward other of said tubular members.

8. A heat exchanger as defined in claim 7, and in which
a. said sheet members define two other elongated tubular members
(1) disposed
(a) on opposite sides of
(1′) said pluralities of openings, and
(2′) said first mentioned tubular members, and
(b) in substantially perpendicular relation to the latter, and
(2) connected to respective opposite ends of said first mentioned tubular members.

9. A heat exchanger as defined in claim 1, and in which
a. said fins on alternate ones of said tubular members are disposed in substantially uniplanar relation to each other.

* * * * *